US009010452B2

(12) United States Patent
Williamson et al.

(10) Patent No.: US 9,010,452 B2
(45) Date of Patent: Apr. 21, 2015

(54) VIBRATION DAMPENING SYSTEM FOR A HANDLE OF A MACHINE THAT VIBRATES, AND METHOD OF DAMPENING VIBRATIONS PRODUCED BY A MACHINE

(76) Inventors: Susan J. Williamson, Clarkston, MI (US); Glen E. Moore, St. Clair Shores, MI (US)

( * ) Notice: Subject to any disclaimer, the term of this patent is extended or adjusted under 35 U.S.C. 154(b) by 635 days.

(21) Appl. No.: 13/272,650

(22) Filed: Oct. 13, 2011

(65) Prior Publication Data

US 2013/0112450 A1 May 9, 2013

(51) Int. Cl.
*B25D 17/24* (2006.01)
*A47L 11/40* (2006.01)

(52) U.S. Cl.
CPC ..... *A47L 11/4075* (2013.01); *A47L 11/4005* (2013.01)

(58) Field of Classification Search
USPC ..... 173/1, 28, 31, 211, 162.1, 162.2, 170; 16/429, 430, 431, 110.1
See application file for complete search history.

(56) References Cited

U.S. PATENT DOCUMENTS

| | | | | | |
|---|---|---|---|---|---|
| 2,659,583 | A | * | 11/1953 | Dorkins | 173/28 |
| 2,904,320 | A | * | 9/1959 | Salisbury et al. | 173/24 |
| 3,369,614 | A | * | 2/1968 | Anthony | 173/186 |
| 3,627,064 | A | * | 12/1971 | Sjoberg et al. | 173/24 |
| 4,667,746 | A | * | 5/1987 | Moraly | 173/89 |
| 5,095,600 | A | * | 3/1992 | Allan | 29/81.16 |
| 5,462,127 | A | * | 10/1995 | Svensson | 173/162.2 |
| 5,667,021 | A | * | 9/1997 | Bailey et al. | 173/21 |
| 6,267,532 | B1 | * | 7/2001 | Persson | 404/133.1 |
| 6,296,467 | B1 | * | 10/2001 | Rouillard | 425/182 |
| 6,404,620 | B1 | * | 6/2002 | Piccione | 361/601 |
| 6,581,246 | B1 | * | 6/2003 | Polette | 16/429 |
| 6,974,904 | B2 | * | 12/2005 | Azzam et al. | 136/244 |
| 7,886,839 | B2 | | 2/2011 | Frauhammer et al. | |
| 7,921,935 | B2 | | 4/2011 | Engelfried et al. | |
| 7,971,655 | B2 | | 7/2011 | Steinke et al. | |
| 2006/0272130 | A1 | | 12/2006 | Togami et al. | |
| 2008/0289842 | A1 | | 11/2008 | Chapple et al. | |
| 2010/0206594 | A1 | | 8/2010 | Meixner | |

FOREIGN PATENT DOCUMENTS

| | | | |
|---|---|---|---|
| CN | 100475455 | C | 4/2009 |
| DE | 102007043917 | | 4/2009 |
| GB | 2435847 | | 12/2007 |
| JP | 2011000705 | A | 1/2011 |

* cited by examiner

*Primary Examiner* — Scott A. Smith
(74) *Attorney, Agent, or Firm* — Howard & Howard Attorneys PLLC

(57) ABSTRACT

A multi-segmented handle built in tiers, with vibration isolators separating one tier from the other tiers. The tier that connects via isolators with a machine base is the one to which the other tiers are attached. The tiers shape is circular or a series of circles to diminish the shock wave and each tiers tubes are filled with a vibration dampening element turning the tier into a harmonic absorber. Each tier has attachments to accommodate the isolators for attaching one tier to another tier. The shapes that the tiers take are not limited to circular but includes all shapes, curved or straight and the isolators include all types of isolators.

20 Claims, 6 Drawing Sheets

VIBRATION DAMPENING SYSTEM FOR A HANDLE OF A MACHINE THAT VIBRATES, AND METHOD OF DAMPENING VIBRATIONS PRODUCED BY A MACHINE

The present invention relates generally to a vibration dampening system for a handle of a machine that vibrates, and a method of dampening vibrations produced by a machine.

More particularly, the present invention relates to a vibration dampening system which includes tiers of tubular tiers interconnected with vibration isolators, and a method of dampening vibrations which includes determining the type, number and arrangement of handle segments and vibration isolators required to dampen the vibration signature of a machine.

BACKGROUND OF THE INVENTION

Operators of various machines, such as, hard surface sander/buffers, soil compactors, carpet sweepers, shop sweepers, sidewalk sweepers, etc., which generate vibrations, often sustain injuries and/or health problems.

The prior, but not necessarily relevant, art is exemplified by: Togami et al. US Patent Application Publication 2006/0272130; Chapple et al. US Patent Application Publication 2008/0289842; Steinke et al. U.S. Pat. No. 7,971,655; Frauhammer et al. U.S. Pat. No. 7,886,839; Engelfried et al. U.S. Pat. No. 7,921,935; and Meixner US Patent Application Publication 2010/0206594.

It is a desideratum of the present invention to provide a novel and unique vibration dampening system for a handle of a machine that vibrates, and a method of dampening vibrations produced by a machine which avoids the animadversions of the conventional and prior art systems and techniques.

SUMMARY OF THE INVENTION

The present invention provides a vibration dampening system for a handle of a machine that vibrates, comprising: a vibration dampening handle apparatus which includes a handle device and multi-segmented tiers having vibration isolators separating each tier from other tiers; said handle device includes a hand-gripping section at one end thereof, and transportation wheels at an opposite end thereof; said multi-segmented tiers are connected between said handle device and the machine; said tiers include a first tier which is connected via vibration isolators to the machine; said tiers include a second transportation tier which is connected to said handle device via vibration isolators; and said tiers include a third intermediate tier which is connected to said first and second tiers via vibration isolators.

The present invention also provides a vibration dampening system for a handle of a machine that vibrates, comprising: a vibration dampening handle apparatus which includes a handle device and multi-segmented tiers having vibration isolators separating each tier from other tiers; said handle device includes a hand-gripping section at one end thereof, and transportation wheels at an opposite end thereof; said multi-segmented tiers are connected between said handle device and the machine; said tiers include a first tier which is connected via vibration isolators to the machine; said tiers include a second transportation tier which is connected to said handle device via vibration isolators; said tiers include a third intermediate tier which is connected to said first and second tiers via vibration isolators; an on-board electrical system for powering the machine; and said on-board electrical system includes one or more batteries, an on-board battery charger, an on-board inverter, wiring means for connecting the batteries to the machine, a control switch near said hand-gripping section, wiring means connecting said control switch to said on-board electrical system, and battery supporting means mounted to said second transportation tier via vibration isolators.

The present invention also provides a method of dampening vibrations produced by a machine, comprising the steps of: determining the vibration signature of the machine; determining the type, number and arrangement of handle segments and vibration isolators required to dampen the vibration signature of the machine; providing a vibration dampening handle apparatus which includes a handle device and multi-segmented tiers having vibration isolators separating each tier from other tiers; providing said handle device with a hand-gripping section at one end thereof, and transportation wheels at an opposite end thereof; connecting said multi-segmented tiers between said handle device and the machine; connecting a first tier via vibration isolators to the machine; connecting a second transportation tier to said handle device via vibration isolators; and connecting a third intermediate tier to said first and second tiers via vibration isolators.

An object of the invention is to provide a system and method as described hereinabove to vibration dampen the handles of equipment having a high vibration signature.

A further object of the invention is to provide a system and method as described hereinabove wherein the tiers include tubular segments.

Another object of the invention is to provide a system and method as described hereinabove including a multi-segmented handle device built in tiers, with vibration isolators separating one tier from the other tiers.

A further object of the invention is to provide a system and method as described hereinabove wherein the handle device includes a tubular member which is filled with a vibration dampening material. Another object of the invention is to provide a system and method as described hereinabove wherein the tier that connects via isolators with the machine base is called the base tier and is the tier to which the other tiers are attached about, either over, under and/or around.

Further objects, advantages and features of the present invention will become apparent to those persons skilled in this particular area of technology and to others after being exposed to the following detailed specification and accompanying drawings.

DETAILED DESCRIPTION OF THE PRESENT INVENTION

Figure 1:
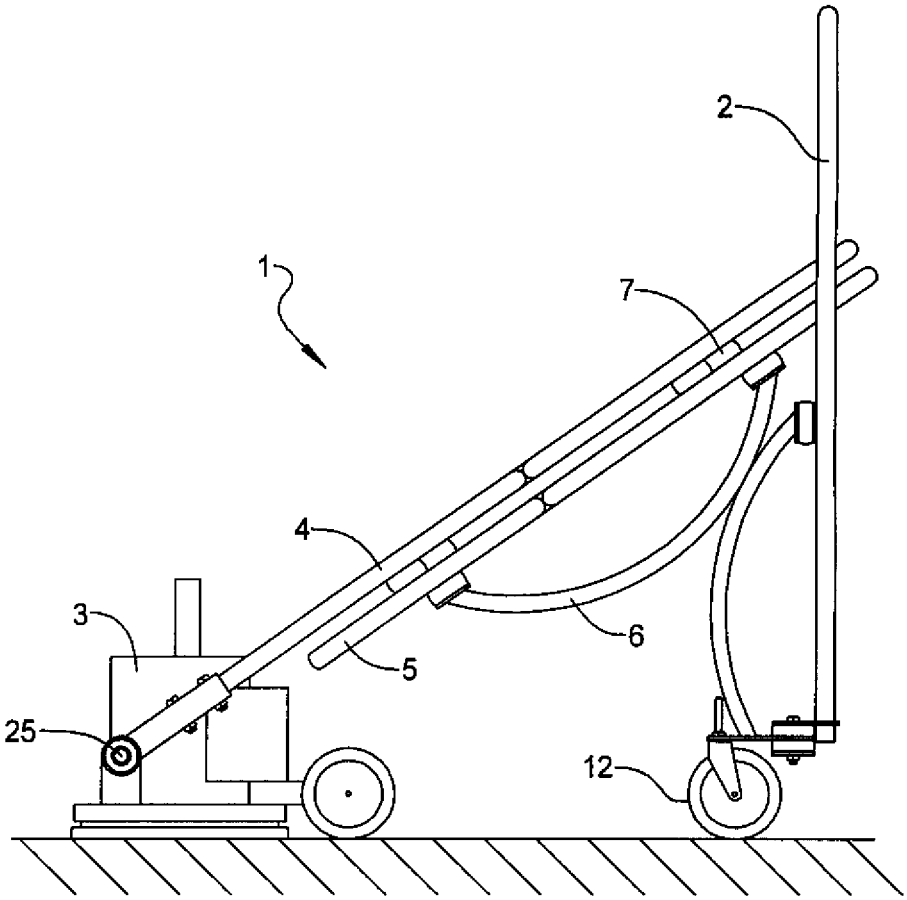
FIG. 1 is side elevational view of a first embodiment of the present invention.

In the drawings, similar components are designated by similar reference numerals.

Figure 2:
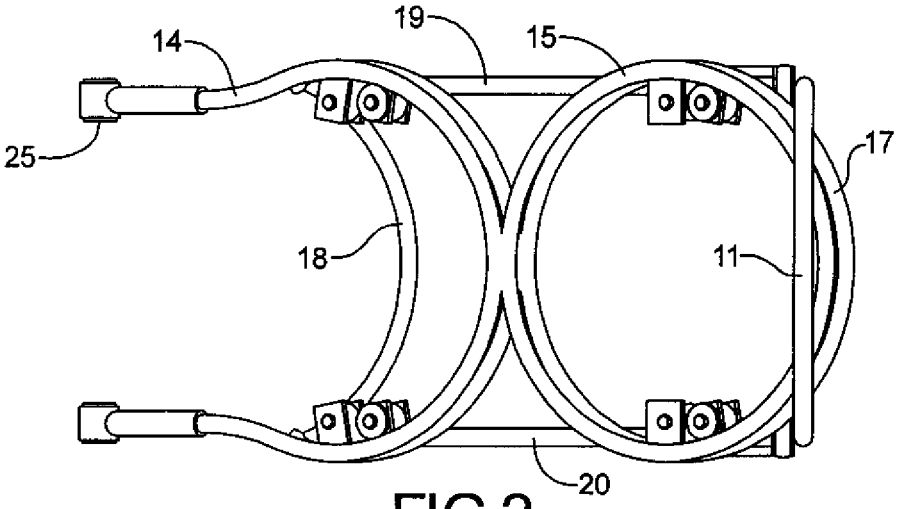
FIG. 2 is a top plan view of the FIG. 1 embodiment.

With reference to FIGS. 1 and 2, there is shown a first embodiment of vibration dampening system or apparatus 1 for a handle 2 of a machine 3 that vibrates.

The vibration dampening handle apparatus 1 includes a handle device 2 and multi-segmented tiers 4, 5 and 6 having vibration isolators 7 separating each tier from other tiers.

The isolators 7 are secured between weld tabs 8 via bolts 9 and nuts 10.

The handle device 2 includes a hand-gripping section 11 at one end thereof, and transportation wheels 12 at an opposite end thereof.

The hand-gripping section 11 includes a grip applique, such as a cushy shock absorbing foam commercially know as Poron, a closed cell foam of a comfortable thickness.

The multi-segmented tiers 4, 5 and 6 are connected between the handle device 2 and the machine 3.

The tiers include a first tier 4 which is connected via vibration isolators to the machine 3. Alternatively, the isolators 25 at the machine base connection may take the form of an area filled with vibration dampening material, such as, for example, silicone, with a bobbin-shaped bushing.

The tiers include a second transportation tier 6 which is connected to the handle device 2 via vibration isolators 7.

The tiers include a third intermediate tier 5 which is connected to the first and second tiers 4 and 6 via vibration isolators 7.

The tiers 4, 5 and 6 include arcuate or circular tubular segments 14, 15, 16, 17, 18, 19, 20, 21, 22 and 23.

The segments 14 and 15 of tier 4 are welded together.

The segments 16, 17 and 18 of tier 5 are welded together.

The segments 19, 20, 21, 22 and 23 of tier 6 are welded together.

The handle device 2 includes a tubular member 24 which is filled with vibration dampening material, such as, for example, silicone.

Figure 3:
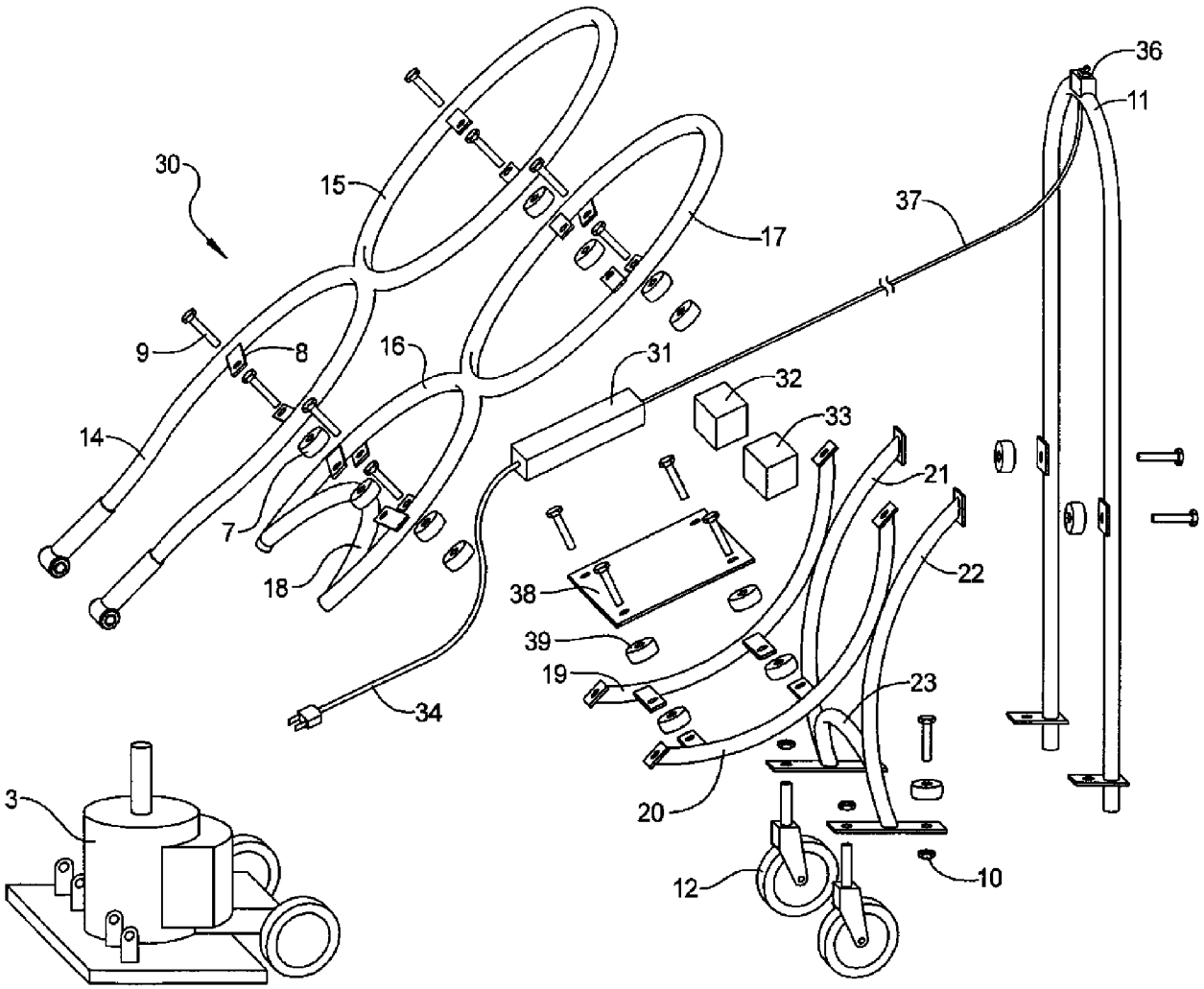
FIG. 3 is an exploded view of second embodiment of the invention.

FIG. 3 illustrates a vibration dampening system or apparatus 30 in accordance with the second embodiment of the invention which is similar to the first embodiment, but with the addition of the on-board electrical system and the components related thereto.

The on-board electrical system powers the machine 3.

The on-board electrical system includes one or more batteries 31, an on-board battery charger 32, an on-board inverter 33, wiring means 34 for connecting the batteries 31 to the machine 3, an ON-OFF/controls switch 36 near the hand-gripping section 11, wiring means 37 connecting the control switch 36 to said on-board electrical system, and battery supporting means 38 mounted to the second transportation tier 6 via vibration isolators 39.

The battery supporting means 38 may comprise a platform which can also support the inverter 33 and battery charger 32.

In FIGS. 1, 2 and 3: the segments 14 and 15 of the first tier 4 are welded together; the segments 16, 17 and 18 of the intermediate tier 5 are welded together; and the segments 19, 20, 21, 22 and 23 of the transport tier 6 are welded together.

Figure 4:
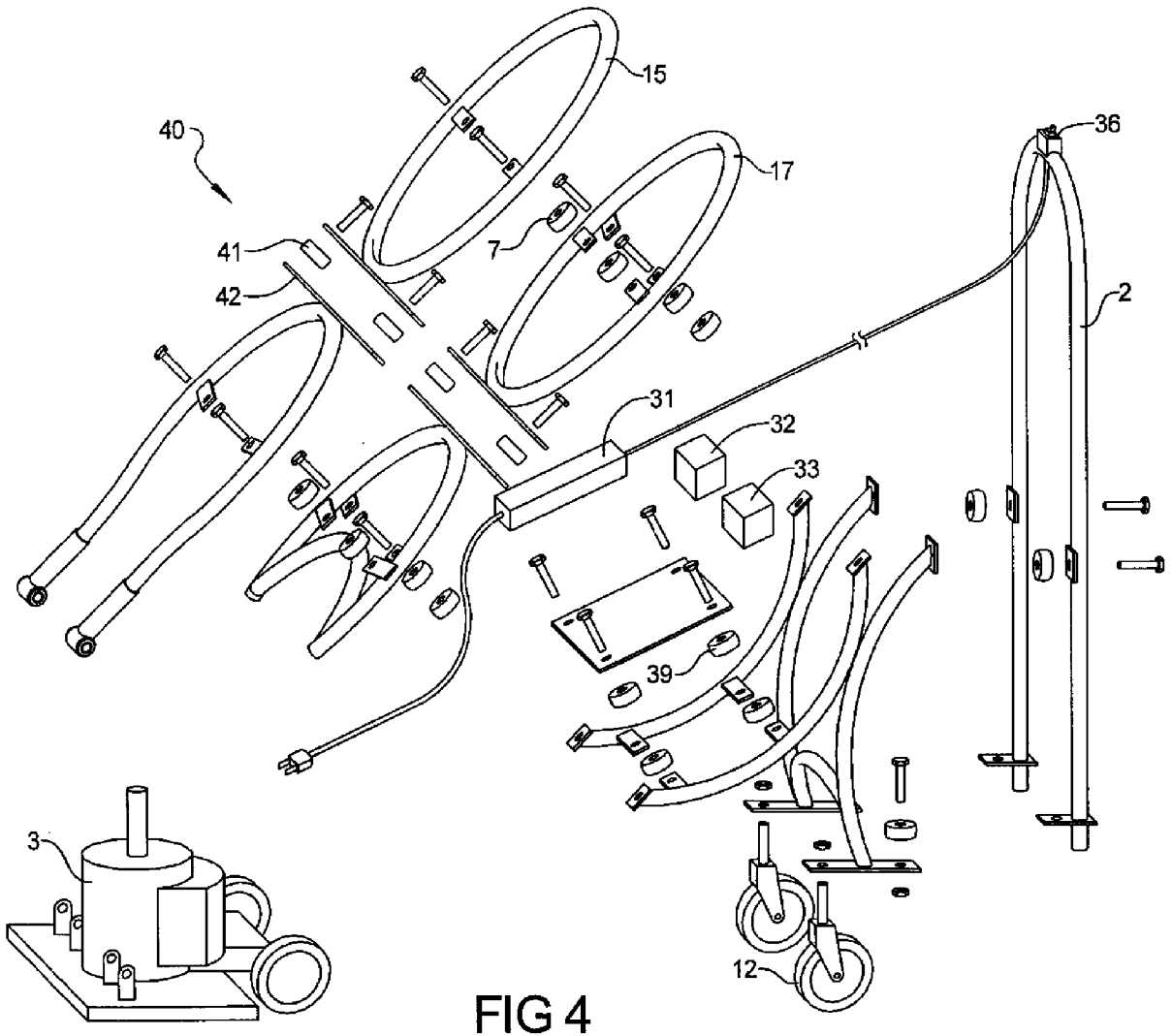
FIG. 4 is an exploded view of third embodiment of the invention.

FIG. 4 illustrates a vibration dampening system or apparatus 40 in accordance with the third embodiment of the invention which is similar to the second embodiment, but with the vibrations isolators 41 replacing the welds between the major segments of the first tier and the third intermediate tier.

The segments are provided with weld tabs 42 between which the isolators 41 are affixed.

Figure 5:
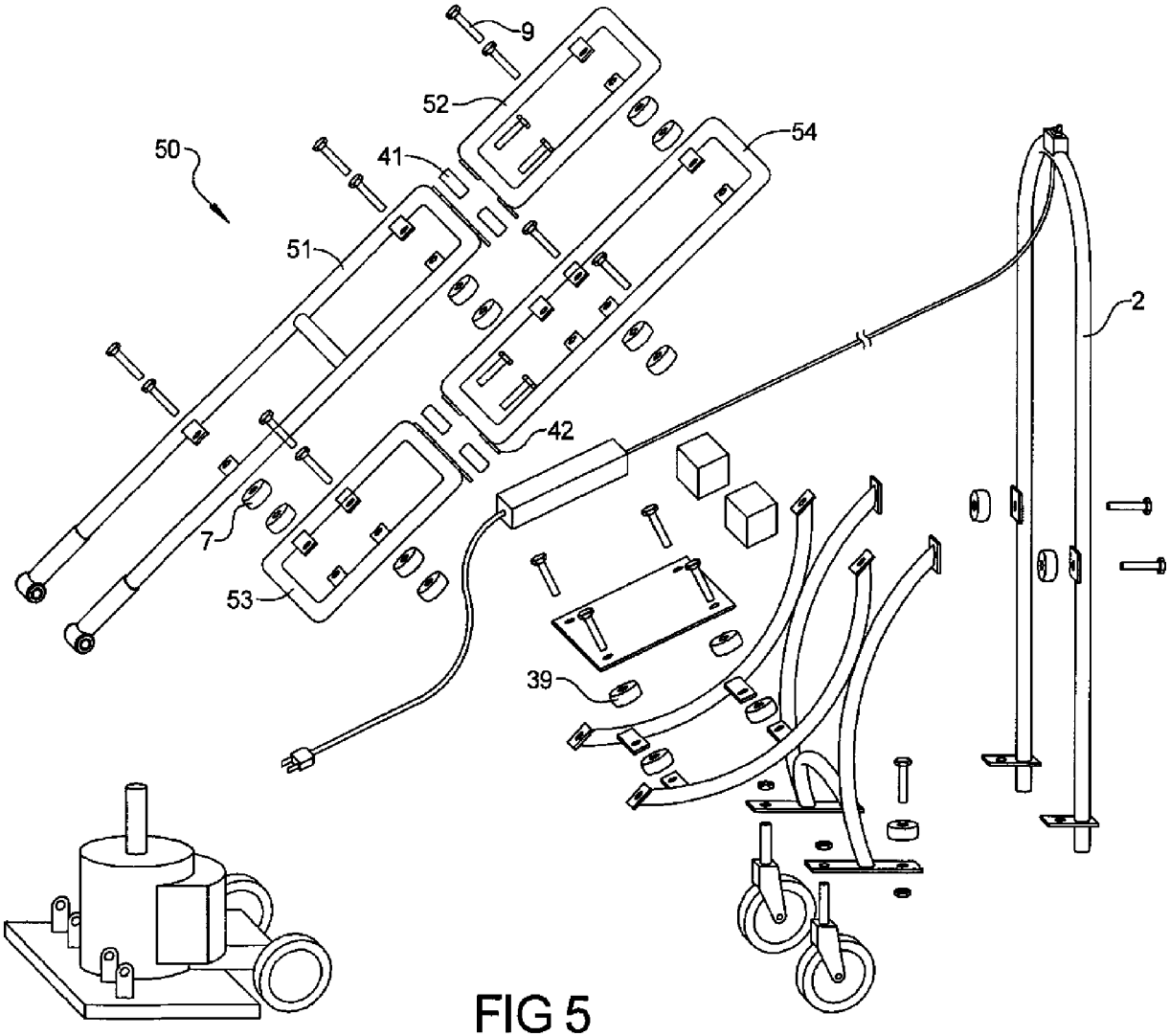
FIG. 5 is an exploded view of fourth embodiment of the invention.

FIG. 5 illustrates a vibration dampening system or apparatus 50 in accordance with a fourth embodiment of the invention which is similar to the third embodiment of FIG. 4, but with substantially rectangular segments 51, 52, 53 and 54 replacing the arcuate or circular segments of the first tier and the third intermediate tier.

Preferably, the joint line with the isolators should be staggered a so that the isolators are not in line with each other.

In FIGS. 1-5, the isolators 25 at the machine base connection may take the form of an area filled with vibration dampening material, such as, for example, silicone, with a bobbin-shaped bushing.

Figure 6:
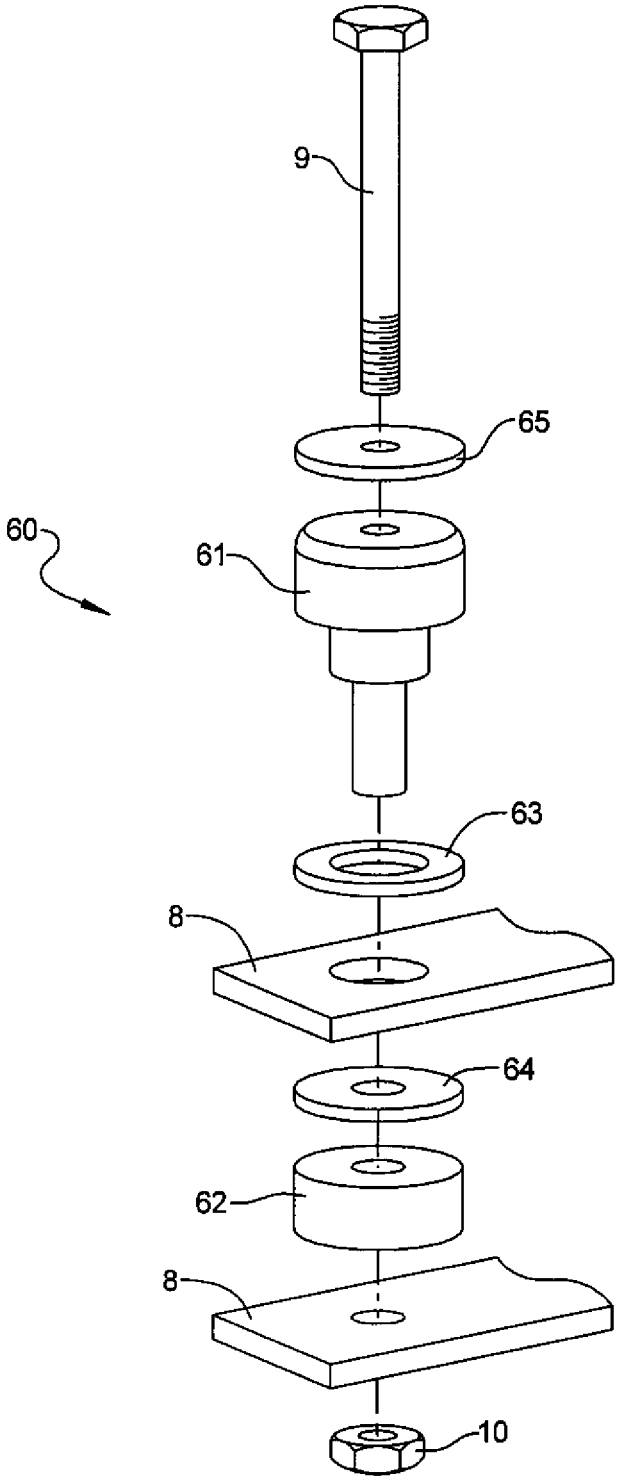
FIG. 6 shows a multi-durometer isolator.

With reference to FIG. 6, there is shown an isolator 60 which differs from the isolators shown in FIGS. 1-5.

The isolator 60 is a multi-durometer isolator.

The main bodies 61 and 62 of the isolator 60 have a durometer of one value, and the spacers 63 and 64 have another lower durometer value.

This arrangement 60 allows for a lower vibration transfer from one segment to the next segment.

While using the machine in normal operating mode, the lower durometer spacers 63 and 64 are active, and the vibration transfer signature reflects the lower durometer value of that element.

However, when. encountering a more vigorous operating mode the lower durometer isolating spacer elements 63 and 64 may compress to the point that the higher durometer isolator bodies 61 and 62 comes into play.

This arrangement 60 allows for a smooth transition from the lower vibration transfer to a higher transfer signature giving the operator the option of backing off operations to the lower vibration signature.

Less time at the higher signature equates to less exposure to harmful carpal tunnel causing vibrations.

A rigid washer 65 made of a vibration damping material is used to further reduce the vibration and acoustic signature.

Figure 7:
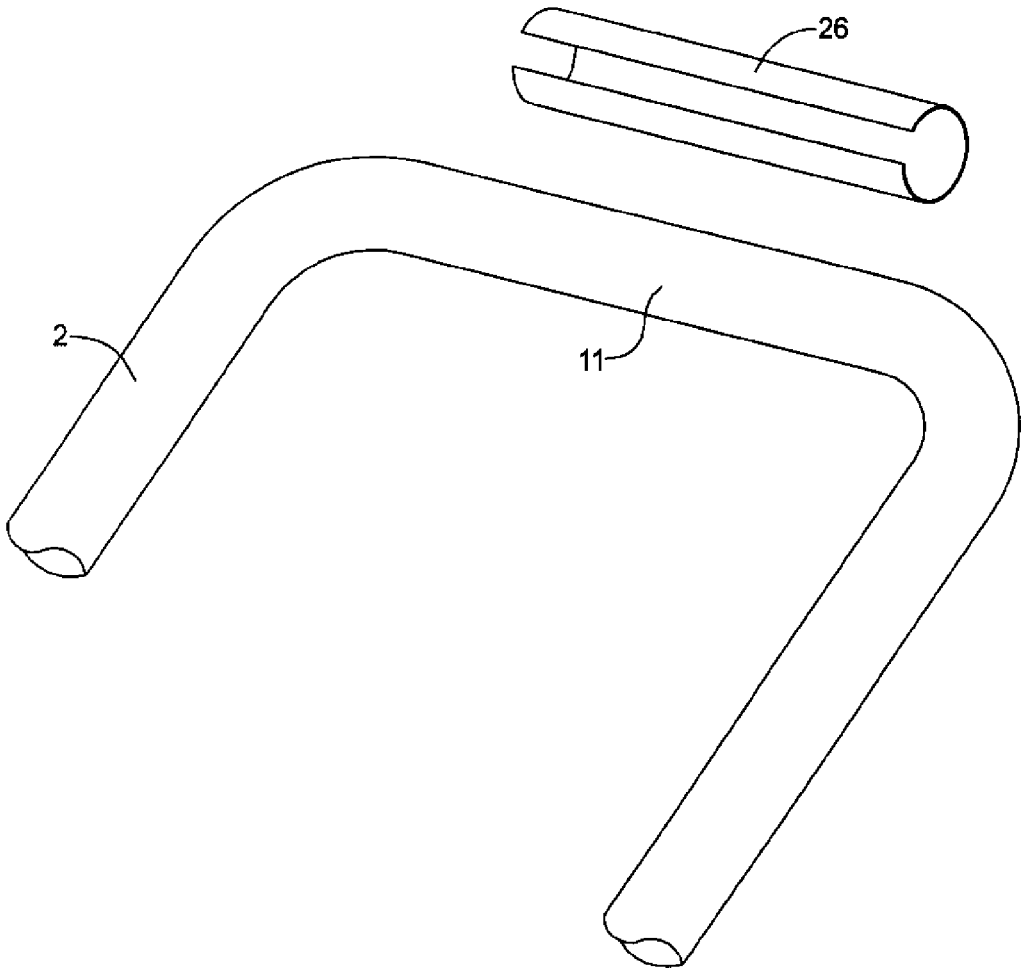
FIG. 7 shows a vibration dampening foam member adhered to the handle as a grip element.

With reference to FIG. 7, there is illustrated a vibration dampening foam member adhered to the handle 2 as a grip element.

It is important to emphasize that the vibration dampening handle in accordance with the present invention is primarily for machines 3 where vibrations are problematic.

In summary, the invention is comprised of a multi-segmented vibration dampening handle with isolators separating the segments, for equipment and machines with a vibration signature requiring dampening so that the operator does not experience the negative effects from the operation of that equipment.

The dampening is partly achieved by the use of strategically placed isolators between multiple segments of a segmented handle.

The shapes of the segments also reduce the vibration signature and are used for that purpose in this application.

The vibrations passed from one segment to the next are reduced by the isolators and the shapes of the segments, and the vibration-reducing material disposed in one or more tubular segments or members.

As the vibrations pass from one segment to the next, they are diminished successively as they travel through the segments to the handle grip.

The segments are not limited as to the number of segments or the number or types of isolators and the segments are not limited as to their shape.

The number of segments required for the dampening of vibrations may change from machine to machine, and therefore would require "tuning" of the number of segments and the types and the effectiveness of the individual isolators for each particular machine's vibration signature.

The handle requires transportation attached as the handle is somewhat heavy. This transportation may include a platform (battery support element) for carrying the weight of batteries for powering the equipment to be used.

Any number of batteries may be used and configured so as to supply any voltage/amperage required allowing cordless operation.

The handle also has as an element a on-board battery charger and a on-board inverter for converting DC to AC and AC to DC for those times when the battery is discharged and the machine can be powered by the grid while recharging the battery at the same time.

The invention also embraces the concept of a handle device having a single stick handle with only one attachment to the base of the machine.

While the present invention has been described in detail with reference to only several preferred particular embodiments thereof, it should be understood that this has been described by way of illustration only, and not by way of limitation.

Reasonable variation and modification are possible within the spirit of the foregoing specification and drawings without departing from the scope of the invention which is defined in the accompanying claims.

The present invention embraces all embodiments, modifications, variations and changes which come within the scope of the patent claims set forth hereinbelow.

The invention claimed is:

1. A vibration dampening system for a handle of a machine that vibrates, comprising:

a vibration dampening handle apparatus which includes a handle device and multi-segmented tiers having vibration isolators separating each tier from other tiers;

said handle device includes a hand-gripping section at one end thereof, and transportation wheels at an opposite end thereof;

said multi-segmented tiers are connected between said handle device and the machine;

said tiers include a first tier which is connected via vibration isolators to the machine;

said tiers include a second transportation tier which is connected to said handle device via vibration isolators; and said tiers include a third intermediate tier which is connected to said first and second tiers via vibration isolators.

2. The vibration dampening, system of claim 1, wherein: said tiers include tubular segments.

3. The vibration dampening system of claim 2, wherein: said handle device includes a tubular member which is filled with a vibration dampening material.

4. The vibration dampening system of claim 3, wherein: said third intermediate tier includes a tubular member which is filled with a vibration dampening material.

5. The vibration dampening system of claim 2, wherein: said third intermediate tier includes a tubular member which is filled with a vibration dampening material.

6. The vibration dampening system of claim 2, wherein: each said tier includes arcuate tubular segments.

7. The vibration dampening system of claim 2, wherein: each said tier includes segments which are connected to each other via vibration isolators.

8. The vibration dampening system of claim 1, wherein: said handle device includes a tubular member which is filled with a vibration dampening material.

9. The vibration dampening system of claim 8, wherein: said third intermediate tier includes a tubular member which is filled with a vibration dampening material.

10. The vibration dampening, system of claim 9, wherein: said first and second tiers each include substantially rectangular shaped tubular segments.

11. The vibration dampening system of claim 1, wherein: said third intermediate tier includes a tubular member which is filled with a vibration dampening material.

12. The vibration dampening system of claim 1, wherein: each said tier includes arcuate tubular segments.

13. The vibration dampening system of claim 1, wherein: said hand-gripping section includes a vibration dampening foam member affixed to said hand-gripping section.

14. The vibration dampening system of claim 1, wherein: said hand-gripping section includes a grip applique made of a shock absorbing loam.

15. The vibration dampening system of claim 1, wherein: each said vibration isolator comprises:

a bolt;

a rigid washer disposed on said bolt;

said washer being made of a vibration dampening material;

a first main isolator body having a first predetermined durometer value;

a first spacer having a second predetermined durometer value;

a first element of said handle apparatus;

a second spacer having said second predetermined durometer value;

a second main isolator body having said first predetermined durometer value;

a second element of said handle apparatus;

a nut threadedly secured on said bolt; and said second predetermined durometer value is lower than said first predetermined durometer value.

16. The vibration dampening system of claim 1, wherein: said first and second tiers each include substantially circular shaped tubular segments.

17. The vibration dampening system of claim 1, wherein: said handle device includes a single stick handle with only one attachment to the base of the machine.

18. The vibration dampening system of claim 1, wherein: said handle device includes a tubular member;

said tiers include tubular segments; and at least one or more of said tubular members and tubular segments are filled with vibration dampening material.

19. A vibration dampening system for a handle of a machine that vibrates, comprising:

a vibration dampening handle apparatus which includes a handle device and multi-segmented tiers having vibration isolators separating each tier from other tiers;

said handle device includes a hand-gripping section at one end thereof, and transportation wheels at an opposite end thereof;

said multi-segmented tiers are connected between said handle device and the machine;

said tiers include a first tier which is connected. via vibration isolators to the machine;

said tiers include a second transportation tier which is connected to said handle device via vibration isolators;

said tiers include a third intermediate tier which is connected to said first and second tiers via vibration isolators;

an on-board electrical system for powering the machine; and said on-board electrical system includes one or more batteries, an on-board battery charger, an on-board inverter, wiring means for connecting the batteries to the machine, a control switch near said hand-gripping section, wiring means connecting said control switch to said on-board electrical system, and battery supporting means mounted to said second transportation tier via vibration isolators.

20. A method of dampening vibrations produced by a machine, comprising the steps of; determining the vibration signature of the machine;

determining the type, number and arrangement of handle segments and vibration isolators required to dampen the vibration signature of the machine;

providing a vibration dampening handle apparatus which includes a handle device and multi-segmented tiers having vibration isolators separating each tier from other tiers;

providing said handle device with a hand-gripping section at one end thereof, and transportation wheels at an opposite end thereof;

connecting said multi-segmented. tiers between said handle device and the machine;

connecting a first tier via vibration isolators to the machine;

connecting a second transportation tier to said handle device via vibration isolators; and connecting a third intermediate tier to said first and second tiers via vibration isolators.

* * * * *

UNITED STATES PATENT AND TRADEMARK OFFICE

CERTIFICATE OF CORRECTION

PATENT NO. : 9,010,452 B2
APPLICATION NO. : 13/272650
DATED : April 21, 2015
INVENTOR(S) : Susan J. Williamson and Glen E. Moore It is certified that error appears in the above-identified patent and that said Letters Patent is hereby corrected as shown below:

In the claims,

Column 6, Claim 14, line 3, “loam” should read -- foam --.

Signed and Sealed this
Third Day of May, 2016

Michelle K. Lee

Michelle K. Lee
*Director of the United States Patent and Trademark Office*